United States Patent [19]

Hochstrasser et al.

[11] 4,113,977

[45] Sep. 12, 1978

[54] PREHEATING SYSTEM WITH GAS RECIRCULATION

[75] Inventors: Otto Hochstrasser, North Brunswick; William S. Ruby, East Brunswick, both of N.J.

[73] Assignee: Brown Boveri Corporation, North Brunswick, N.J.

[21] Appl. No.: 826,189

[22] Filed: Aug. 19, 1977

[51] Int. Cl.[2] ..... F27D 13/00; F27D 17/00

[52] U.S. Cl. ..... 13/2 R; 214/18 SC; 219/400; 266/901; 432/72

[58] Field of Search ..... 219/388 R, 388 C, 400; 13/2, 25, 23; 432/72, 222; 266/901; 214/18 SC

[56] References Cited

U.S. PATENT DOCUMENTS

| | | | |
|---|---|---|---|
| 3,669,436 | 6/1972 | Kemmetmueller | 214/18 C X |
| 3,933,343 | 1/1976 | Rawlings | 266/901 X |
| 4,012,190 | 3/1977 | Dicks et al. | 13/2 R X |

*Primary Examiner*—R. N. Envall, Jr.

*Attorney, Agent, or Firm*—Fitzpatrick, Cella, Harper & Scinto

[57] ABSTRACT

Scrap metal is preheated by electrical radiant heating means. Volatiles driven off from the metal are mixed with air and are blown through conduits which constitute the electrical radiant heating elements. Combustion takes place inside the conduits and the products of combustion are directed through openings in the conduits onto the scrap metal. The temperature and pressure in the system is controlled by dampers arranged at each end of the conduits to vary gas recirculation.

23 Claims, 7 Drawing Figures

PREHEATING SYSTEM WITH GAS RECIRCULATION

BACKGROUND OF THE INVENTION

1. Field of the Invention

This invention relates to heating systems and more particularly it concerns novel arrangements for preheating solid aggregate material, such as scrap metal, to drive off volatiles from the material before the material is melted.

2. Description of the Prior Art

U.S. Pat. No. 3,383,099 shows a preheating system suitable for heating scrap metal prior to charging the metal into a melting furnace. In that system a charge of scrap metal to be preheated is held in a bucket and hot gases from a group of gas or oil burners are driven through the charge. This arrangement has been found to provide very rapid and efficient preheating of metals. In addition, the burners of such preheaters can operate at very high temperatures for long periods of time without need for replacement. Also the combustible volatiles which are driven off during preheating can be burned in the process and, to a certain extent their heat of combustion can be recovered. Some inefficiency occurs in these systems, however, because of their need to heat large amounts of combustion air which is later exhausted as waste heat.

It has also been proposed to employ electrical heating systems of the type shown and described in U.S. patent application Ser. No. 701,013 filed June 30, 1976, and assigned to the assignee of the present invention, for preheating scrap metal. These electrical preheating systems utilize heating elements which are raised to high temperature by passing large electrical currents through them; and the heat developed by these elements is radiated onto the scrap metal. These electrical heating systems are efficient in that they do not require the heating of combustion air. However they do not have the capability to make effective use of the heat of combustion of the combustible volatiles driven off from the scrap metal.

SUMMARY OF THE INVENTION

The present invention provides the advantages of the radiant heat type preheating systems; and at the same time it permits effective recovery of the heat of combustion of the volatiles which are driven off from the material being preheated.

According to the present invention, material which contains vaporizable combustible constituents is preheated by applying sufficient heat to the material to vaporize the combustibles. The vaporized combustibles are mixed with air to form a combustible mixture and this mixture is directed through a conduit located adjacent the material to be heated. The combustible mixture is ignited in and around the conduit to generate additional heat which is directed from the conduit onto the material to be heated.

In a preferred form of the invention, scrap metal to be preheated is placed in an open top container which is positioned under a preheater hood. Gas flow conduits extend along inside the hood; and blower means are provided to withdraw gases from within the hood and to direct them, as a combustible mixture, back through the conduits. The conduits are electrically conductive and means are provided to cause electrical current to flow through them so that they become heated. This heat is radiated from the conduits onto the scrap metal. At the same time, the combustible mixture in the conduits is raised to a temperature above its ignition temperature. This produces combustion of the mixture and the products of this combustion are directed through openings in the conduits down onto the scrap metal to assist in the preheating operation. Exhaust and recirculation dampers are provided at each end of the conduits and these are adjusted to maintain predetermined pressures and temperatures within the system.

There has thus been outlined rather broadly the more important features of the invention in order that the detailed description thereof that follows may be better understood, and in order that the present contribution in the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A single embodiment of the invention has been chosen for purposes of illustration and description and is shown in the accompanying drawings forming a part of this specification, wherein:

FIG. 3 is a view taken along line 3—3 of FIG. 1;

Figure 1:
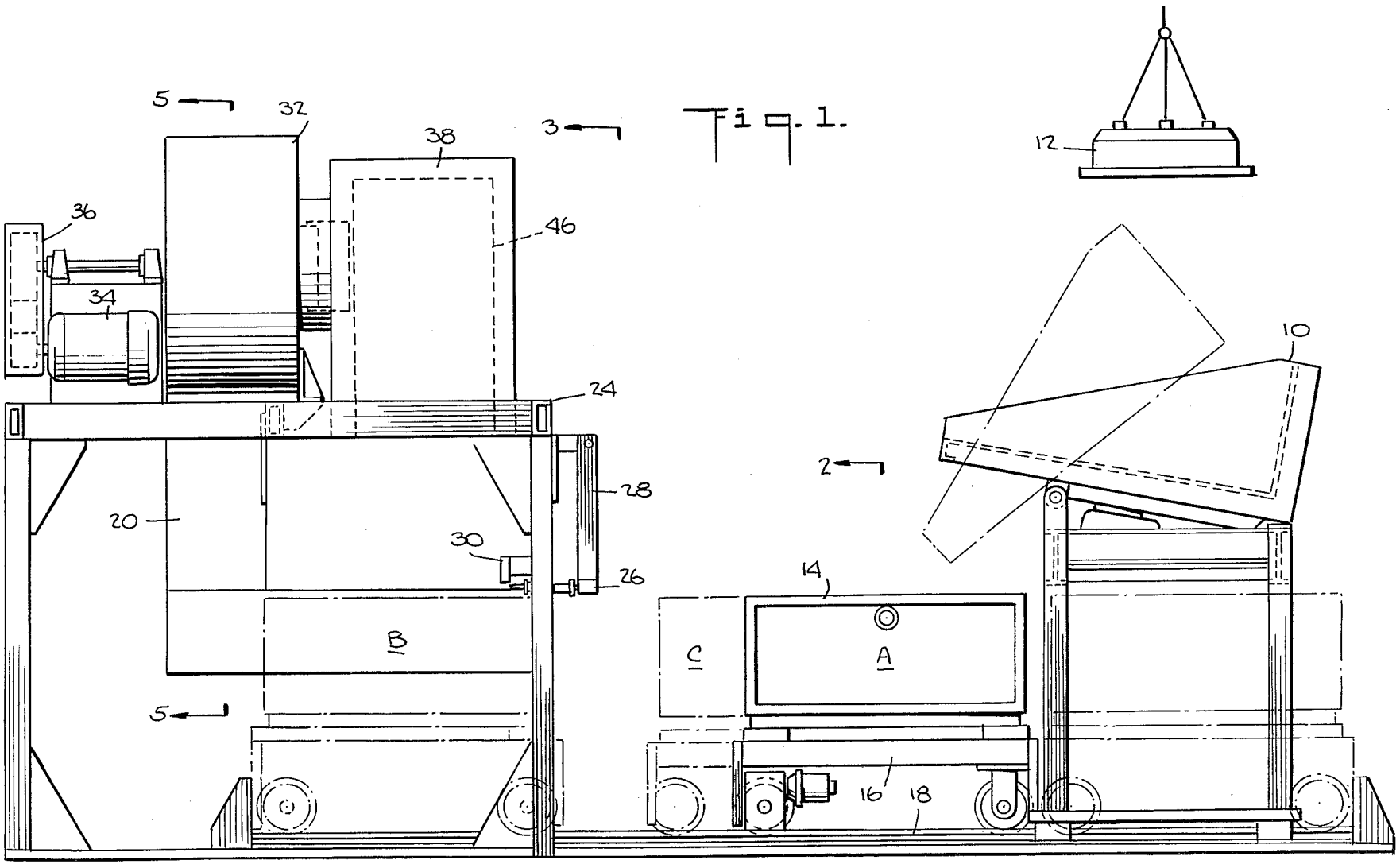
FIG. 1 is an elevational view of a scrap metal preheater system in which the present invention is embodied.

The preheater system of FIG. 1 operates to prepare scrap metal for charging into a melting furnace such as an induction furnace. During this charging operation there is already present in the melting furnace a considerable quantity of molten metal; and, because of the high temperatures present inside the melting furnace, it is important that the temperature of the scrap metal be raised prior to the charging operation. This preheating serves to drive volatile constituents such as oil, water, etc. off from the scrap metal. If these volatile constituents were present on the scrap metal when it is submerged into the molten metal in the furnace they would cause violent and very dangerous eruptions within the furnace. Also, it has been found that preheating scrap metal before it is charged into a melting furnace will permit the melting furnace to operate at high efficiency.

In the preheater system of FIG. 1 scrap metal is first supplied to a weight hopper 10 by means of a suitable conveying means such as a scrap feeder magnet 12. When a predetermined weight of scrap metal has been delivered to the weight hopper it is dumped (as shown in phantom outline) into a dryer car 14. The dryer car 14 is carried by a truck 16 which in turn rolls on rails 18, from a loading position A, shown in solid outline to preheating and dumping positions B and C, respectively shown in phantom outline.

Figure 2:
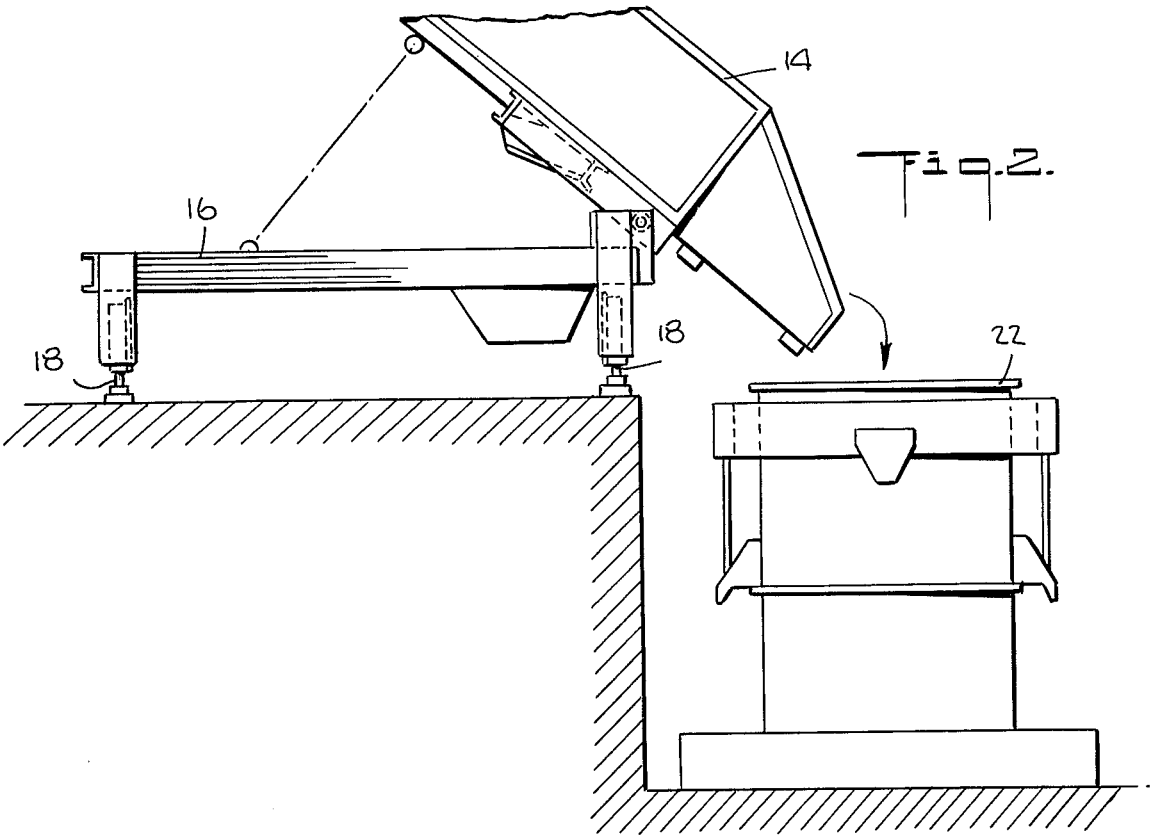
FIG. 2 is a view taken along line 2—2 of FIG. 1.

When the dryer car 14 has received its charge of scrap metal it is driven along the rails 18 to the preheating position B under a dryer hood 20. As will be described in greater detail hereinafter, the scrap metal in the dryer car 14 is preheated to a predetermined temperature, e.g. 700° F. (371° C.) while the car is under the dryer hood 20. After the scrap metal has been so preheated, the car 14 is driven back to the dumping position C. As shown in FIG. 2 the dryer car 14 is then dumped so that the preheated scrap metal falls into a charging bucket 22. This bucket is then transferred by suitable means (not shown) to a melting furnace.

As shown in FIGS. 1 and 3 the dryer hood 20 is supported over the rails 18 by means of a framework structure 24. There is also provided a spreader bar 26 which extends alongside the framework structure 24 and the dryer hood 20 and this bar is swingably suspended from the framework structure by means of support arms 28. When the dryer car 14 moves into position under the dryer hood 20, any mounded scrap metal in the car first contacts the spreader bar 26 and is leveled in the car so that it can pass under the hood. At the same time should scrap jam and swing the spreader bar toward the hood this movement will actuate a detector contact 30 to reverse direction of car.

Figure 4:
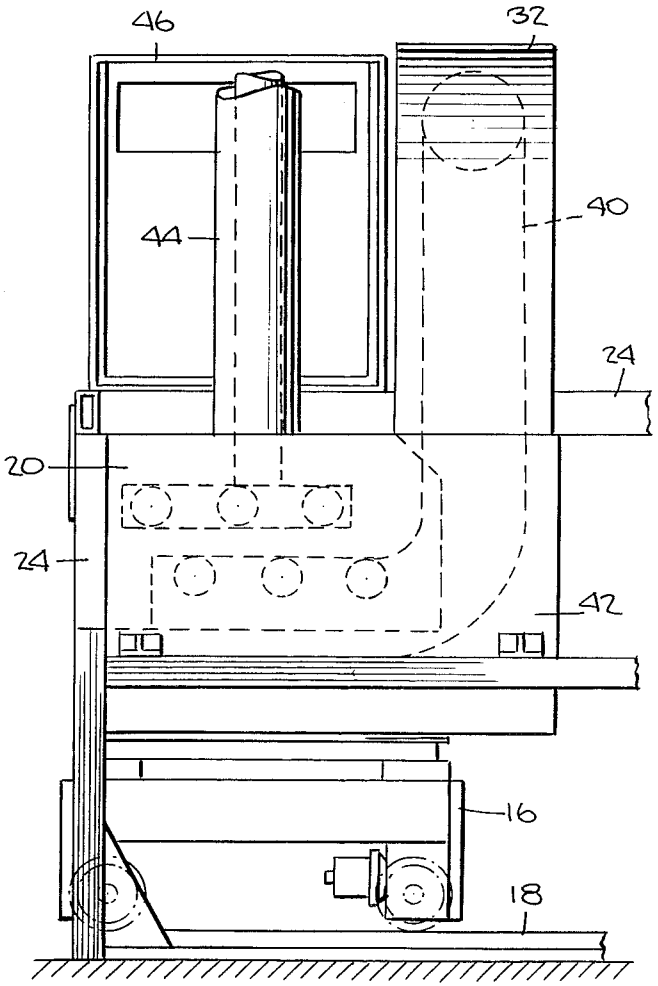
FIG. 4 is a view taken along line 4—4 of FIG. 3.

As shown in FIG. 1 a centrifugal type recirculation blower 32 is mounted on the framework 24 above the hood 20. A blower drive motor 34 is also mounted on the framework 24 and is connected via a drive train 36 to operate the blower. A blower intake plenum 38 extends up from the hood 20 and is connected to the intake of the blower 32. The blower outlet, as shown in FIGS. 3 and 4, is connected to a recirculation gas duct 40 which extends down to a manifold housing 42 alongside the hood 20. An exhaust duct 44 of double wall insulated construction extends up from the manifold housing 42 and may be connected to a suitable exhaust pipe (not shown).

An electrical transformer 46 is also mounted on the framework 24; and, as will be explained in greater detail, this transformer supplies electrical power to provide preheating under the hood 20.

Figure 5:
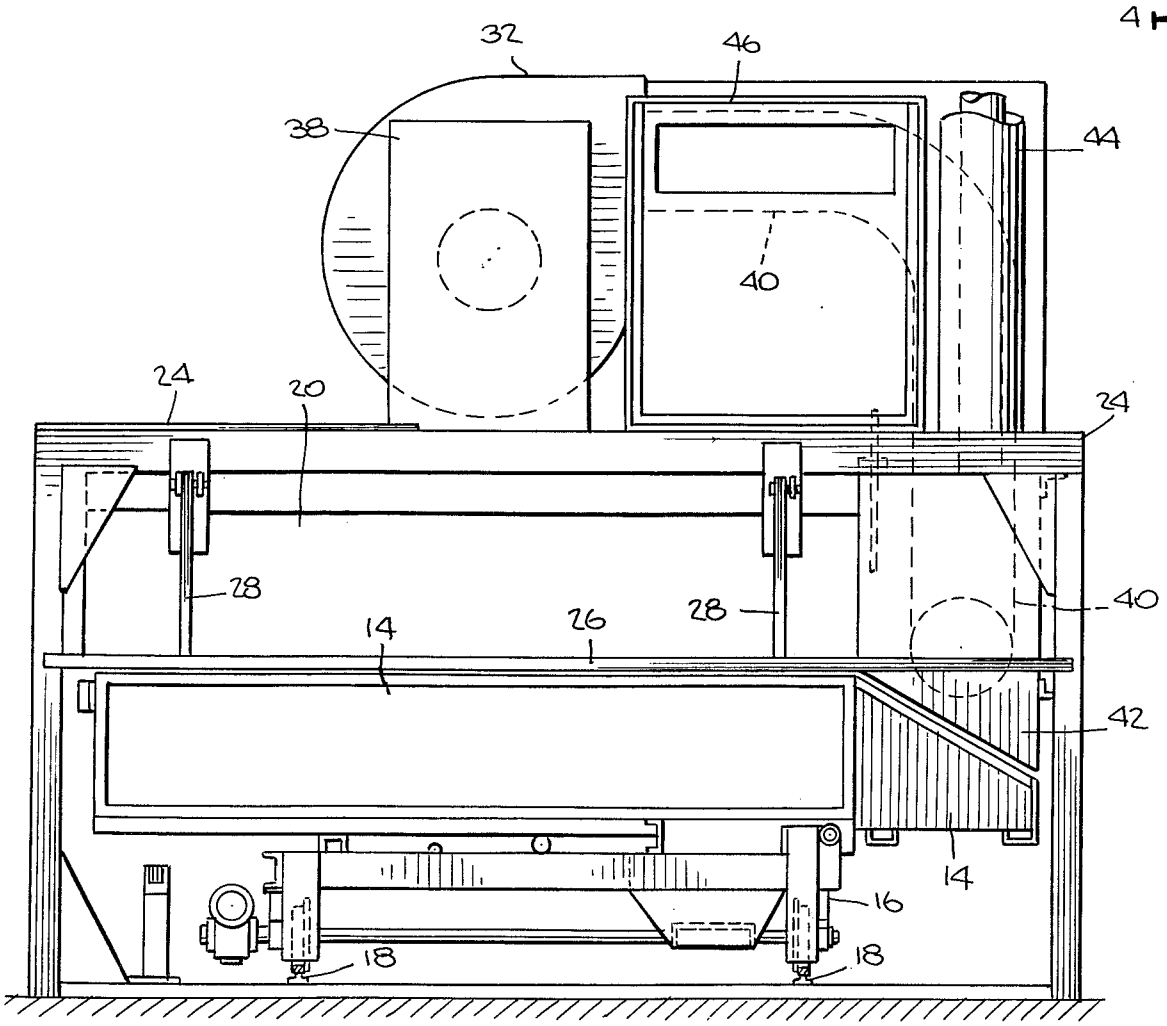
FIG. 5 is an enlarged section view showing the interior of the preheater system as viewed in FIG. 3.
Figure 5:
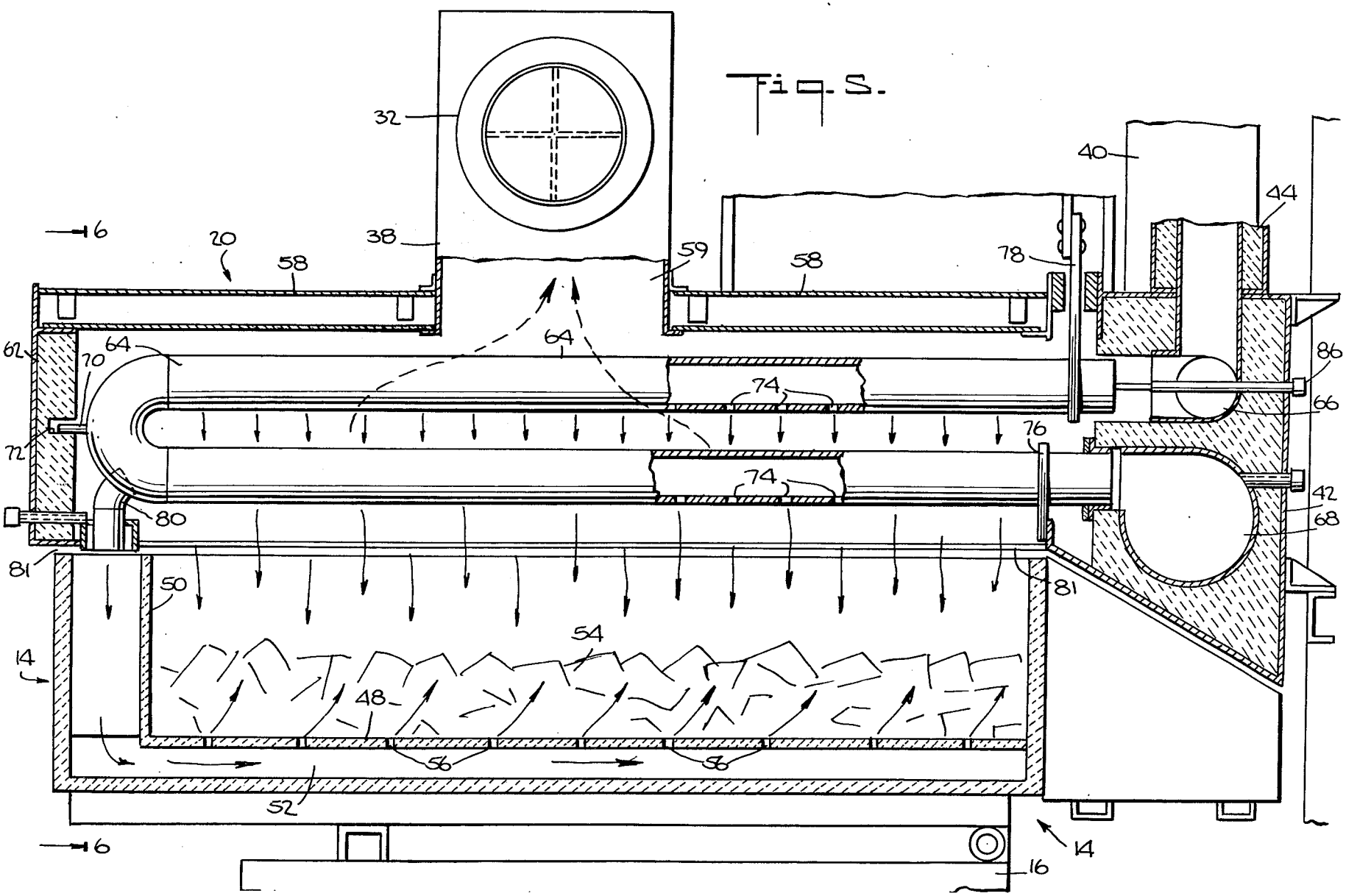

As shown in FIG. 5 the dryer car 14 has an inner floor 48 and an inner wall 50 spaced a slight distance away from the bottom and one side of the car to define an underfeed duct 52. Scrap metal 54 to be heated is supported on the inner floor 48 and heated gases from the underfeed duct 52 pass up through openings 56 in the inner floor 48 into the charge of scrap metal 54.

Figure 6:
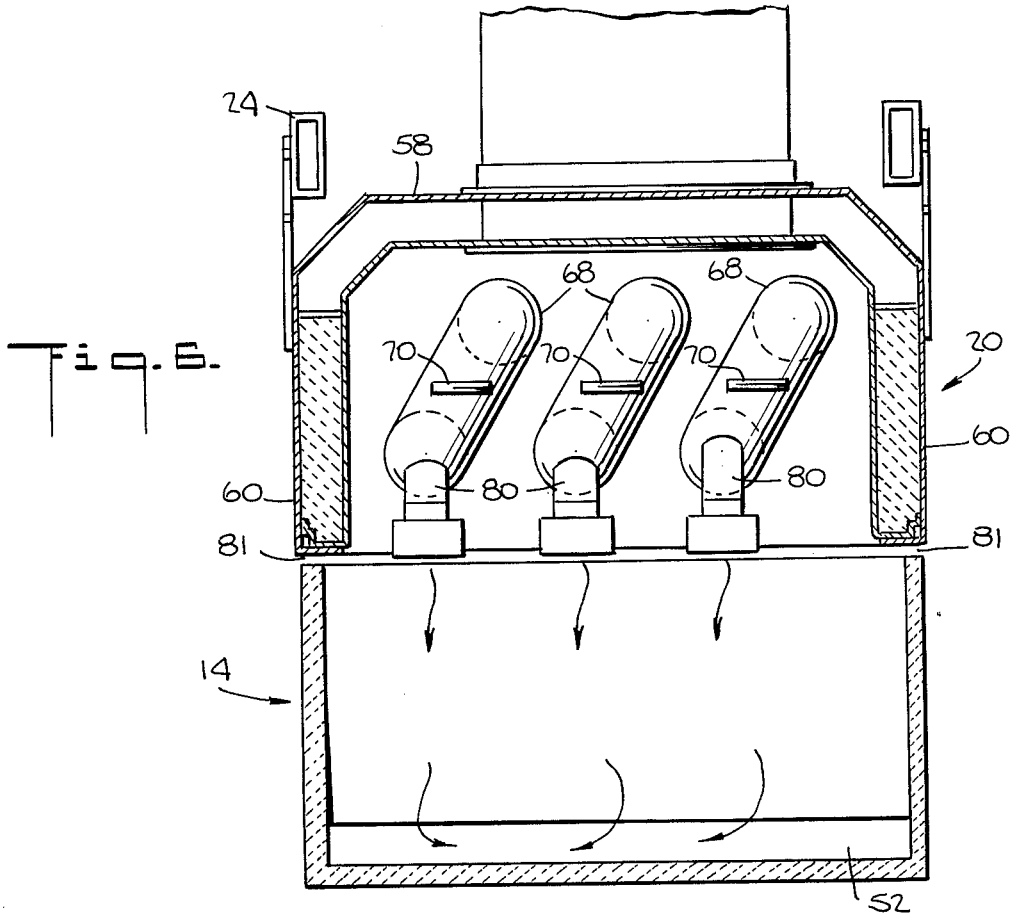
FIG. 6 is a view taken along line 6—6 of FIG. 5.

The dryer hood 20, as shown in FIGS. 5 and 6, is of insulated double wall construction and is formed with a top wall 58, side walls 60, an end wall 62 at one end and the manifold housing 42 at the opposite end. The hood 20 opens downwardly over the dryer car 14. Also the top wall 58 is provided with an opening 59 leading from the interior of the hood to the blower intake plenum 38.

A plurality of U-tube gas flow conduits 64 extend across the interior of the dryer hood 20 between the manifold housing 42 and the end wall 62. One end of each of the U-tube conduits 64 opens into a common exhaust manifold 66 inside the manifold housing 42; and this common exhaust manifold, as shown in FIGS. 4 and 5, communicates with the exhaust duct 44. The other end of each of the U-tube conduits 64 opens into a common recirculation gas manifold 68 inside the manifold housing 42; and this recirculation gas manifold in turn communicates with the recirculation gas duct 40. The curved end of each of the U-tube conduits 64 is provided with a support bracket 70 which rests on a ledge 72 formed in the insulating material in the end wall 62. Gas outlet openings 74 are distributed along the lower surface of each of the U-tube conduits 64.

As can also be seen in FIGS. 5 and 6, the U-tube conduits 64 are arranged side by side in the hood 20 and they are tilted slightly so that each conduit leg is directly exposed to the scrap metal 54 in the dryer car 14 under the hood. While the embodiment shown herein employs three U-tube conduits, a greater number may be provided for larger systems. The lower end of each of the conduits 64 passes through and is connected to a common, horizontal, electrically conductive ground plate 76 mounted on the hood 20. The opposite or upper end of each of the conduits 64 passes through and is connected to its associated electrically conductive connector plate 78. These connector plates extend down from and are directly connected to the three phase secondary or output of the transformer 46.

The conduits 64 are made of an electrically conductive heat resistant material and they may, for example, be of a chromium, nickel steel alloy such as described in the aforementioned copending U.S. patent application Ser. No. 701,013.

An underfeed supply conduit 80 extends out from the bent end of each of the U-tube conduits 64 and down to the underfeed duct 52 of the dryer car 14 when it is positioned under the hood. This permits a portion of the hot gases flowing through the conduits 64 to pass through the duct 52, the openings 56 and up through the scrap metal 54.

It will also be seen in FIGS. 5 and 6 that when the dryer car 14 is positioned under the hood 20, the upper edges of the dryer car and the lower edges of the hood cooperate to define an air gap or opening 81 of limited size through which atmospheric air is admitted, in limited quantities, into the enclosure defined by the car and the hood. This air becomes mixed inside the hood with the combustible gases driven off from the scrap metal 54 to form a combustible mixture.

Figure 7:
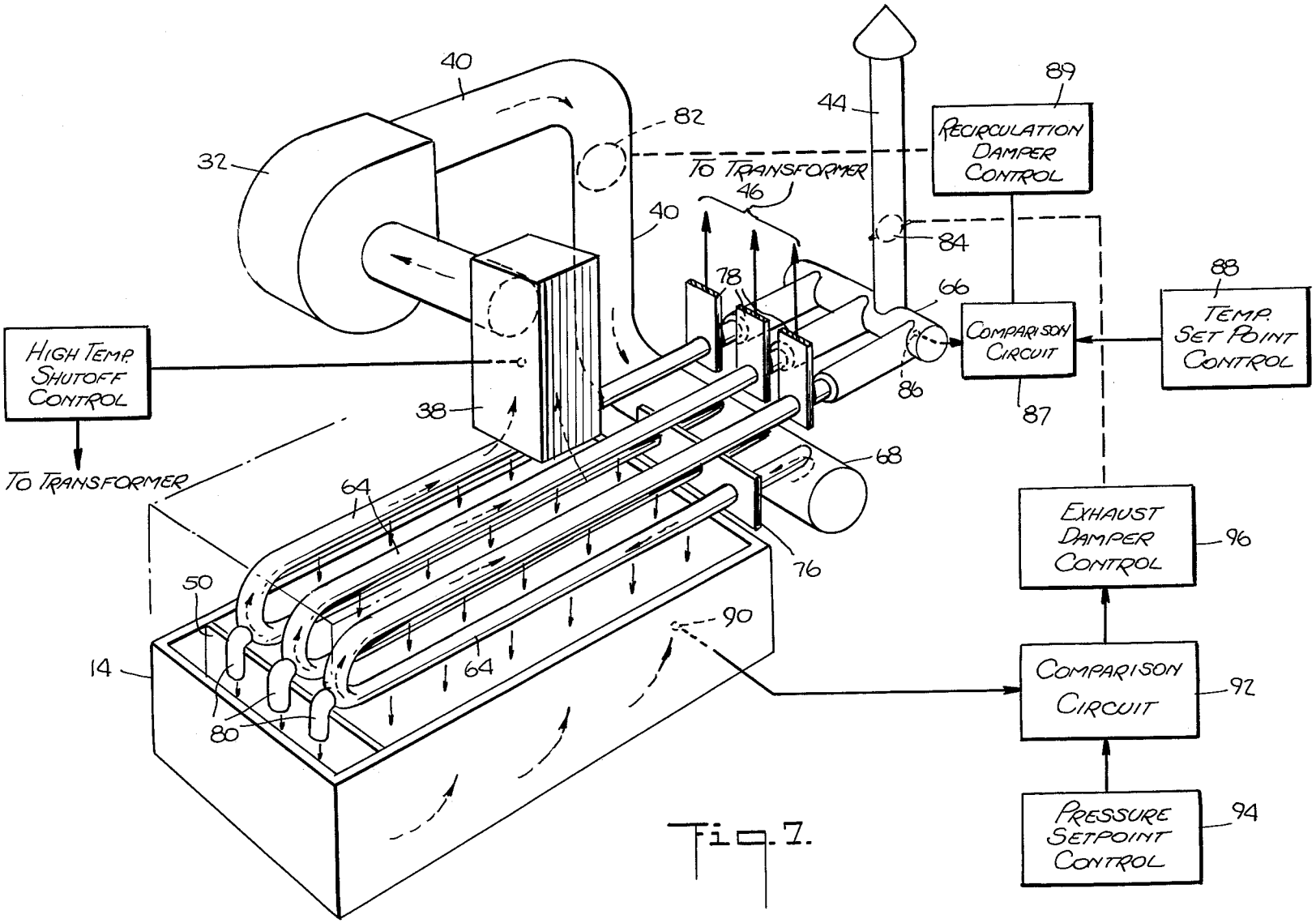
FIG. 7 is a diagrammatic view, taken in perspective, of a control arrangement for the preheater system of FIG. 1.

FIG. 7 illustrates, in diagrammatic fashion, the electrical and fluid connections to the U-tube gas flow conduits 64. As can be seen, gases from the interior of the hood 20 are drawn up through the blower intake plenum 38 and are forced by the blower 32 through the recirculation duct 40 to the recirculation gas manifold 68. From there the gases are forced through the U-tube conduits 64 and back into the exhaust manifold 66. The gases are collected in the exhaust manifold and are then exhausted through the exhaust duct 44. In the meantime three phase electrical power is supplied from the secondary of the transformer 46 through the connector plates 78 to one end of each of the U-tube conduits 64. The other ends of conduits are electrically connected together by means of the ground plate 46 to form a wire type electrical load. Electrical current from the transformer passes along the length of each of the U-tube conduits and causes them to become heated.

FIG. 7 additionally shows control arrangements for gases flowing through the system. As shown in FIG. 7 a recirculation damper 82 is provided in the recirculation duct 40 and an exhaust damper 84 is provided in the exhaust duct 44. U-tube temperature sensors 86 (FIGS. 5 and 7) are arranged in the manifold housing 42 and extend into the exhaust end of each of the U-tube conduits 64. These temperature sensors produce electrical signals corresponding to the temperature of the gases flowing through the conduits. Signals from the temperature sensors 86 are compared in a comparison circuit 87 with electrical signals from a temperature setpoint control 88; and the resulting difference signal is supplied to a recirculation damper control 89. The recirculation damper control, in turn, is connected to adjust the recirculation damper 82. A pressure sensor 90 is also provided interiorly of the hood 20 and this sensor produces pressure signals which are compared in a comparison circuit 92 with a setpoint signal supplied from a pressure setpoint control 94. The resulting difference signal produced by the comparison circuit 92 is supplied to an exhaust damper control 96 which in turn is connected to adjust the exhaust damper 84. Other pressure and temperature sensors may be provided to sound alarms and/or cut off operating power when operating conditions exceed certain predetermined levels. For example, a recirculation temperature sensor 96 may be provided in the blower intake plenum 38 and may be connected to a high temperature shutoff control 98 arranged to disconnect the transformer 46 should the temperature within the hood 20 rise beyond a safe level.

In operation of the preheating system the dryer car 14 is first loaded with the charge 54 of scrap metal or other material to be preheated and the car is then positioned under the hood 20 as shown in FIG. 5. When the car 14 is under the hood 20, the blower 38 operates to drive gases from within the hood 20 around through the recirculation gas duct 40 and through the U-tube conduits 64. Also, at the same time, the transformer 46 supplies electrical current which passes along the length of and heats the U-tube conduits.

The heated U-tube conduits 64 radiate heat down onto the charge 54. As the charge becomes heated, volatile materials, such as hydrocarbons and the like, which may be present on the surfaces and interstices of the charge 54, become volatilized and are driven off from the charge. The recirculation blower 38 maintains a negative, i.e. below atmospheric, pressure in the interior of the hood 20 above the charge 54. As a result, atmospheric air is drawn into the hood via the gaps or openings 81 (FIGS. 5 and 6) between the upper edges of the dryer car 14 and the lower edges of the hood 20. This air is mixed with the volatiles which have been driven off from the scrap charge 54 to form a combustible mixture. The combustible mixture is then driven by the blower back through the recirculation gas duct 40 and through the heated U-tube conduits 64. Because the conduits 64 are electrically heated, their internal temperature is above the ignition temperature of the combustible mixture passing through them. As a result, the hydrocarbons and other combustibles in the mixture are burned inside the U-tube conduits. The heat from this combustion helps to maintain the high temperature of the U-tube conduits and thus the heat content of the volatiles is recovered to preheat additional portions of the charge 54. The gaps or openings 81 admit only enough air to combust the gases driven off from the charge 54 so that no energy is wasted in heating large quantities of air which merely becomes exhausted to the atmosphere at high temperature.

The combustion which takes place inside the U-tube conduits 64 also produces expansion of the combustion products; and the expanding hot gases jet out through the gas outlet openings 74 and provide additional connective heat transfer to the scrap charge 54. Additionally a portion of the hot expanding gases pass down through the underfeed supply conduits to the underfeed duct 52 in the dryer car 14. These latter mentioned gases then pass through the openings 56 of the inner floor 48 to heat the charge 54 from underneath. In this way the charge 54 becomes preheated to a substantially uniform temperature.

After the charge 54 has become preheated to a predetermined temperature, the dryer car 14 is withdrawn from under the hood back to position C (FIG. 1). The dryer car 14 is then tilted as shown in FIG. 2 to dump the preheated charge into the charging bucket 22. The dryer car 14 is then returned to position A where it receives an additional charge to be preheated.

It is desirable to maintain a negative or below atmospheric pressure under the hood 20 during the preheating operation. This negative pressure serves to draw combustion air into the system to mix with the combustible gases driven off from the charge 54. At the same time the negative pressure under the hood 20 prevents the emission of smoke from under the hood. The negative pressure, which preferably is maintained in an amount equivalent to 0.125–0.250 inches (0.32–0.64 cm) of water, is controlled by adjustment of the exhaust damper 84. Should the pressure under the hood 20 rise toward atmospheric pressure, this pressure rise will be sensed by the pressure sensor 90. The pressure sensor in turn generates an electrical signal which, when compared in the comparison circuit 92 with the signal produced by the pressure setpoint control 94, causes the exhaust damper control 96 to open the exhaust damper 84, thereby allowing a greater portion of the recirculating gases in the U-tube conduits 64 to exit from the system. As a result the pressure inside the hood 20 is made more negative. If the pressure under the hood 20 should be reduced too far below atmospheric pressure, the resulting pressure signals will cause the exhaust damper 84 to close so that a greater portion of the recirculating gases will be forced back into the hood 20 and thus bring the pressure back up toward atmospheric.

It is also preferred to control the temperature of the U-tube conduits during the preheating operation in order to prevent them from deteriorating while still providing an adequate preheating rate. Preferably the U-tube conduits should be maintained at an operating temperature within the range of 1200°–1600° F. (650°–879° C.). This temperature is controlled by adjustment of the recirculation damper 82. Should the temperature within the U-tube conduits 64, as sensed by the temperature sensors 86, rise beyond a predetermined level, the electrical signals generated by these sensors is compared in the comparison circuit 87 with the signal from the temperature setpoint control 88 and the resultant signal is applied to the recirculation damper control 89 to open the recirculation damper 82. This allows more air to be drawn into the system by the recirculation blower 32 and this additional air passes through and cools the U-tube conduits 64. Should the U-tube conduit temperature decrease beyond a predetermined level, as established by the setting of the temperature setpoint control 88, the resulting electrical signal applied to the recirculation damper control 89 operates to close the damper 82 and reduce the amount of recirculation air.

It will be appreciated that since both the recirculation damper 89 and the exhaust damper 84 are partially in the same gas flow path, they may interact to a certain degree. Accordingly in some instances it may be desired to provide appropriate damping adjustments on the controllers 89 and 96 to prevent hunting or oscillation of the system. It may also be desired to provide additional pressure and temperature sensors at appropriate locations in the system with suitable safety interlocks to ensure, for example, that the scrap charge is not overheated or that the dryer car is not brought into position under the hood 14 until the hood itself has been brought up to operating temperature.

It will be appreciated from the foregoing that the system of the present invention permits efficient and rapid preheating of scrap metals and the like with a minimum of pollution. The combustible volatiles in the scrap material being heated are vaporized and mixed with a controlled amount of air so that they become completely burned in the U-tube conduits. As a result the heat content of these volatiles is utilized in the preheating operation itself and the resulting gaseous discharge from the system is composed essentially of carbon dioxide and water vapor. Thus the system, in addition to being efficient from the standpoint of energy utilization, is also desirable from the standpoint of its essentially non-polluting characteristics.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A method of heating material which contains vaporizable combustible constituents, said method comprising the steps of:

applying sufficient heat to said material in an enclosure to vaporize said combustible constituents;

mixing the thus vaporized combustible constituents with air to form a combustible mixture and directing the combustible mixture through a conduit extending within said enclosure and located adjacent to materials to be heated;

passing electrical current along said conduit within said enclosure to raise its temperature above the ignition temperature of said combustible mixture to generate heat in said conduit; and directing heat from said conduit to said material to be heated.

2. A method according to claim 1 wherein heat is directed from said conduit by blowing at least a portion of the products of combustion, which takes place within said conduit, out through openings in said conduit toward said material to be heated.

3. A method according to claim 2 wherein said portion of said products of combustion are recirculated back through said conduit.

4. A method according to claim 3 wherein the remainder of said products of combustion are exhausted from said conduit.

5. A method according to claim 4 wherein the amount of exhausted products of combustion is controlled by actuating an exhaust damper at the outlet of said conduit.

6. A method according to claim 1 wherein said conduit is heated by passing electrical current through it and radiant heat from said conduit is directed to said material to be heated.

7. Apparatus for heating material which includes vaporizable combustible constituents, said apparatus comprising an enclosure for containing said material, at least one conduit extending inside said enclosure, blower means arranged to withdraw vaporized combustible constituents from said enclosure and to direct said constituents, together with combustion air, as a combustible mixture, through said conduit and electrical circuit means connected to direct electrical current through said conduit inside said enclosure to heat said conduit above the ignition temperature of said mixture contained therein.

8. Apparatus according to claim 7 wherein said conduit is provided with openings for directing products of combustion, which occurs inside said conduit, out toward said material.

9. Apparatus according to claim 7 wherein one end of said conduit is connected to the output of said blower means and the other end of said conduit is connected to exhaust.

10. Apparatus according to claim 8 wherein said enclosure is formed with openings to admit air to be mixed with said vaporized combustible constituents to form said combustible mixture.

11. Apparatus according to claim 7 wherein damper means are provided along the fluid flow path between said blower and said conduit.

12. Apparatus according to claim 9 wherein damper means are provided between said conduit and exhaust.

13. Apparatus according to claim 7 wherein there are provided a plurality of said conduits with one end of each conduit connected to a common recirculation manifold and the other end of each conduit connected to a common exhaust manifold.

14. Apparatus according to claim 7 including means forming a gas duct extending from said conduit to the bottom of said enclosure, said gas duct having openings along the bottom of said enclosure to direct hot gases produced in said conduit, up through said material from the bottom thereof.

15. An electrical heating system comprising an open top container for containing material to be heated, a hood extending over the top of said container to form an enclosure, a plurality of conduits extending along the inside of said hood, blower means arranged to withdraw gases from inside said hood and to direct said gases, as a combustible mixture, through said conduits, said conduits being electrically conductive and arranged in an electrical circuit so that electrical current flows along said conduit and heats them to a temperature sufficient to ignite the combustible mixture flowing through them.

16. An electrical heating system according to claim 15 wherein said enclosure is formed with an opening to admit outside air which is mixed with vaporized combustible materials inside said enclosure to form said combustible mixture.

17. An electrical heating system according to claim 16 wherein said opening is formed by gaps between said container and said hood.

18. An electrical heating system according to claim 15 wherein said conduits are provided with openings for directing products of combustion, which occurs inside said conduit, out toward said material.

19. An electrical heating system according to claim 18 wherein one end of each of said conduits is connected to a common recirculation manifold and the other end of each of said conduits is connected to a common exhaust manifold.

20. An electrical heating system according to claim 19 wherein said hood is formed with an opening leading to the input of said blower and wherein the output of said blower is connected to said recirculation manifold.

21. An electrical heating system according to claim 20 wherein a recirculation damper is provided in said recirculation manifold.

22. An electrical heating system according to claim 19 wherein an exhaust duct is connected to said exhaust manifold and an exhaust damper is provided in said exhaust duct.

23. An electrical heating system according to claim 15 wherein said container is formed with an underfeed duct in fluid communication with said conduits, said underfeed duct being defined in part by a floor of said container on which material to be heated is supported, said floor having openings therealong to direct hot gases from said duct up through the material in the container.

* * * * *